United States Patent [19]

Webb et al.

[11] 4,353,974

[45] Oct. 12, 1982

[54] PROCESS FOR THE PRODUCTION OF PHOTOGRAPHIC IMAGES AND PHOTOGRAPHIC MATERIALS USED IN THIS PROCESS

[75] Inventors: Terence C. Webb, Danbury; Patrick D. P. Thomas, Chelmsford; William E. Long, Brentwood, all of England

[73] Assignee: Ciba-Geigy AG, Basel, Switzerland

[21] Appl. No.: 237,012

[22] Filed: Feb. 23, 1981

[30] Foreign Application Priority Data

Feb. 28, 1980 [GB] United Kingdom ..... 8006847

[51] Int. Cl.[3] ..... G03C 5/54

[52] U.S. Cl. ..... 430/218; 430/222; 430/239; 430/241; 430/256; 430/364; 430/390; 430/436; 430/438; 430/523; 430/559; 430/961

[58] Field of Search ..... 430/218, 222, 239, 241, 430/390, 559, 436, 438, 523, 961, 256, 364

[56] References Cited

U.S. PATENT DOCUMENTS

| | | | |
|---|---|---|---|
| 4,233,399 | 11/1980 | Kitzing et al. | 430/510 |
| 4,269,928 | 5/1981 | Mason et al. | 430/242 |
| 4,271,254 | 6/1981 | Mason et al. | 430/239 |

*Primary Examiner*—J. Travis Brown
*Attorney, Agent, or Firm*—Joseph G. Kolodny

[57] ABSTRACT

A process for the production of a photographic image which comprises (a) imagewise exposing a photographic assembly which comprises at least during a silver halide developing step, in order optionally a supercoat layer, at least one silver halide emulsion layer, a layer containing a layer substantive hydroxypyridone azamethine compound of the general formula (1)

wherein $R_1$ is hydrogen or an optionally substituted alkyl, aralkyl, cycloalkyl, aryl, amino or heterocyclic radical, Y represents hydrogen or hydroxy, —CN, —$COOR^1$, —$CONR^1R^2$ or —$COR^1$ or an optionally substituted alkyl, aralkyl, cycloalkyl, aryl or heterocyclic radical and Z is hydrogen or is —CN, —$COOR^3$, —$CONR^3R^4$, —$SO_3H$, —$SO_3^-$ or —$COR^3$, where $R^1$, $R^2$, $R^3$ and $R^4$ each independently represent hydrogen or an optionally substituted alkyl, aralkyl, cycloalkyl, aryl or heterocyclic radical, and E represents the atoms necessary to complete an optionally substituted heterocyclic or aromatic ring, and a support, there being optionally one or more interlayers between each of said components, (b) treating the exposed photographic assembly with an aqueous alkaline processing bath, containing a silver halide developer and (c) in the non-latent image areas, allowing the silver halide developer to diffuse in a counter-imagewise manner from the silver halide emulsion layer(s) to the layer containing the compound of formula (1) and there to bleach the compound to form a photographic dye image.

The developers used in this process exhibit an increased stability against oxidizing agents.

34 Claims, 11 Drawing Figures

PROCESS FOR THE PRODUCTION OF PHOTOGRAPHIC IMAGES AND PHOTOGRAPHIC MATERIALS USED IN THIS PROCESS

This invention relates to novel silver halide photographic materials and to methods of processing these materials to produce photographic images.

Ever since the advent of photography silver halide salts have been used as the photosensitive agent and for the most part developed silver has been used as the image although in colour photography final dye images have replaced the silver image. However in a large number of photographic materials the final image is still a silver image, e.g. in X-ray materials, microfilms and in graphic arts films, as well as in normal black and white high speed camera films. Recently, however, the price of silver has increased to such an extent that ways have been sought in which silver halide can still be used as the photosensitive agent but in which a final dye image is formed even in the photographic materials listed above. By such means there can be either an almost total recovery of the silver used or at least a great reduction in the amount of silver used.

In one method of colour photography the photosensitive agent is a silver salt and a dye developer is used which develops the silver halide and at the same time releases a dye which diffuses out of the photosensitive layers into a receptor layer which can be peeled apart from the photosensitive layer. Thus a final dye image is obtained whilst leaving all the silver in the residual material and thus recoverable.

There is described in GB-A-2.007.378 a novel photographic diffusion process which does not involve the diffusion of dyes but in which a final dye image is obtained.

In GB-A-2.007.378 there is described a process for the production of a photographic image which comprises the steps of:

(a) imagewise exposing a photographic assembly which comprises at least during the silver halide developing step, in order optionally a supercoat layer, at least one silver halide emulsion layer, a layer containing a bleachable dye image and a photobase, there being optionally one or more interlayers between each of said components, (b) treating the exposed photographic assembly with an aqueous processing bath so as to provide in the silver halide emulsion layer or layers a solution or dispersion of a bleach-developer, thereby to develop the latent silver image in the silver halide emulsion(s), and (c) in the non-latent image areas allowing the bleach-developer to diffuse in a counter-imagewise manner from the silver halide emulsion layer(s) to the layer containing the bleachable dye image and there to bleach the image dye to form a photographic image.

In GB-A-2.007.378 bleach-developer compounds are defined as substances which are able to act both as a silver halide developing agent and as a bleaching agent for a bleachable dye.

In GB-A-2.007.378 the preferred bleachable image dyes are stated to be azo dyes of the type used in silver dye bleach processes.

Such azo dyes are bleached in acid conditions and thus in the Examples set forth in GB-A-2.007.378 the aqueous processing bath is an aqueous acid bath. The preferred bleach-developer for use with the azo dyes in said process are stated to be reduced silver dye bleach catalysts of the diazine type and certain metallic ions in their lower valency states. Both these classes of compounds are able to act as silver halide developing agents in aqueous acid conditions. However both types of bleach-developer readily oxidised to their inactive forms and various ways of ensuring that the active form of the bleach-developer are present in the aqueous processing solution are described in GB-A-2.007.378.

We have now discovered that a certain class of dyes may be image-wise bleached in aqueous alkaline conditions by normal silver halide developing agents which are not so readily oxidised as are the bleach-developer described in GB-A-2.007.378.

Therefore according to the present invention there is provided a process for the production of a photographic image which comprises the steps of (a) imagewise exposing a photographic assembly which comprises at least during a silver halide developing step, in order optionally a supercoat layer, at least one silver halide emulsion layer, a layer containing a layer substantive hydroxypyridone azamethine of the general formula

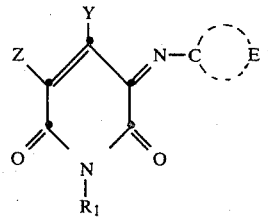

(1)

wherein $R_1$ is hydrogen, optionally substituted alkyl, aralkyl, cycloalkyl or aryl, or an optionally substituted heterocyclic radical or amino group, Y is hydrogen, hydroxyl, cyano, —$COOR^1$, —$CONR^1R^2$ or —$COR^1$, optionally substituted alkyl, aralkyl, cycloalkyl or aryl, or an optionally substituted heterocyclic radical, Z is hydrogen or is cyano, —$COOR^3$, —$CONR^3R^4$, —$SO_3H$, —$SO_3^-$ or —$COR^3$, where $R^1$, $R^2$, $R^3$ and $R^4$ each independently are hydrogen, optionally substituted alkyl, aralkyl, cycloalkyl or aryl or an optionally substituted heterocyclic radical, and E represents the atoms necessary to complete an optionally substituted heterocyclic or aromatic ring, and a support, there being optionally one or more interlayers between each of said components, (b) treating the exposed photographic assembly with an aqueous alkaline processing bath so as to provide in the silver halide emulsion layer or layers a solution or dispersion of a silver halide developer, thereby to develop the latent silver image in the silver halide emulsion(s), and (c) in the non-latent image areas allowing the silver halide developer to diffuse in a counter-imagewise manner from the silver halide emulsion layer(s) to the layer containing the compound of formula (1) and there to bleach the compound to form a photographic dye image.

Another object of the invention is the photographic material which can be used in the inventive process.

A further object of the invention is the photographic image produced with the photographic material which can be used in the photographic process.

Preferred aromatic rings E are a phenylene ring with a para-substituted amine or substituted amine and a phenylene ring with a para-substituted hydroxy group. There may be other substituents on the phenylene ring.

Mostly preferred heterocyclic rings E are pyrazolone or hydroxypyridone rings.

The term layer substantive means that the azamethine dyes are substantive to the layer in which they are coated. As hereinafter described, preferably the dyes are present as solid dispersions but they may be present as oil dispersions or mordanted to a mordant, or rendered substantive by reasons of molecular size.

A particularly preferred class of compounds of formula (1) are those of formula

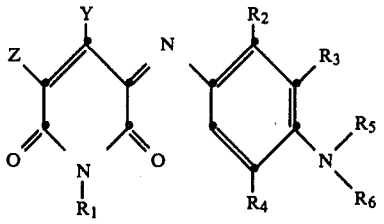

(2)

wherein $R_1$ represents hydrogen or optionally substituted alkyl, aralkyl, cycloalkyl, aryl or an optionally substituted heterocyclic radical or amino group, Y represents hydrogen or hydroxy, cyano, —$COOR^1$, —$CONR^1R^2$ or —$COR^1$ or optionally substituted alkyl, aralkyl, cycloalkyl or aryl or an optionally substituted heterocyclic radical and Z is hydrogen or represents cyano, —$COOR^3$, —$CONR^3R^4$, —$SO_3H$, —$SO_3^-$ or —$COR^3$, where $R^1$, $R^2$, $R^3$ and $R^4$ each independently represent hydrogen or optionally substituted alkyl, aralkyl, cycloalkyl or aryl or an unsubstituted heterocyclic radical, $R_2$, $R_3$ and $R_4$ are each hydrogen or each independently represent hydrogen, halogen, optionally substituted alkyl or cycloalkyl or alkoxy, and $R_5$ and $R_6$ each independently represent hydrogen or optionally substituted alkyl, aralkyl, cycloalkyl, aryl or heterocyclic radical or $R_5$ and $R_6$ together with the nitrogen atom to which they are attached form a 5- or 6-membered ring, or $R_3$ and $R_5$ together with the nitrogen atom and $R_5$ and $R_6$ together with the nitrogen atom form two condensed rings.

The optionally substituted alkyl radicals represented by Y, $R_1$, $R^1$, $R^2$, $R^3$ and $R^4$ are preferably lower alkyl groups or substituted lower alkyl radicals, and as specific examples of such radicals there may be mentioned methyl, ethyl, n-propyl, n-butyl, n-octyl, n-decyl and n-dodecyl, hydroxy lower alkyl such as β-hydroxymethyl, lower alkoxy alkyl with 1 to 6 carbon atoms in the alkoxy and alkyl radical such as β-(methoxy or ethoxy)-ethyl and γ-methoxypropyl, cyano lower alkyl such as cyanomethyl, carbamoylmethyl, carbethoxymethyl, and acetylmethyl.

As examples of aralkyl radicals represented by Y, $R_1$ and $R^1$, $R^2$, $R^3$ and $R^4$ there may be mentioned benzyl and β-phenyl ethyl.

As an example of a cycloalkyl radical represented by Y and $R_1$, $R^1$, $R^2$, $R^3$ and $R^4$ there may be mentioned cyclohexyl. The optionally substituted aryl radicals represented by Y, $R_1$, $R^1$, $R^2$, $R^3$ and $R^4$ are preferably phenyl or optionally substituted phenyl radicals, and as specific examples of such radicals there may be mentioned phenyl, tolyl, chlorophenyl, methoxyphenyl and ethoxyphenyl. The optionally substituted heterocyclic radicals represented by Y, $R_1$, $R^1$, $R^2$, $R^3$ and $R^4$ are preferably 5- and 6-membered heterocyclic rings and as specific examples of such radicals there may be mentioned 2-pyridyl, 2-thiazolyl, 1-piperidinyl and 1-morpholinyl, each of which may be substituted.

As examples of 5- and 6-membered heterocyclic rings formed by joining $R_5$ and $R_6$ and the nitrogen atom, or $R_3$ and $R_5$ and the nitrogen atom, or $R_4$ and $R_6$ and the nitrogen atom, there may be mentioned piperidine, morpholine, piperazine and pyrrolidine.

Z is preferably —CN, —$COOR^3$ or —$CONR^3R^4$ wherein $R^3$ and $R^4$ are hydrogen or alkyl of 1 to 3 carbon atoms.

Of special interest is further the inventive process for preparing dyestuffs of formula (1), wherein $R_1$ is hydrogen, alkyl of 1 to 6 carbon atoms, hydroxyalkyl of 1 to 6 carbon atoms, alkoxyalkyl of 1 to 6 carbon atoms each in the alkyl and the alkoxy radical, phenyl, benzyl, β-phenylethyl or cyclohexyl, $R_2$ is hydrogen, chloro alkyl, hydroxyalkyl or alkoxy each of 1 to 6 carbon atoms, $R_3$ is hydrogen, alkyl or alkoxy of 1 to 6 carbon atoms, $R_4$ is hydrogen or alkyl of 1 to 6 carbon atoms, $R_5$ and $R_6$ are hydrogen, alkyl or hydroxyalkyl of 1 to 6 carbon atoms, alkoxyalkyl of 1 to 6 carbon atoms each in the alkyl and the alkoxy radical, carboxyalkyl with 1 to 3 carbon atoms in the alkyl radical, β-methylsulphonamidoethyl or sulpho-n-butyl, Y is hydrogen, cyano, carbomethoxy, carbethoxy, carbamoyl or alkyl of 1 to 6 carbon atoms and Z is cyano, carbomethoxy, carbethoxy or carbamoyl.

Preferred dyestuffs are those of the formula

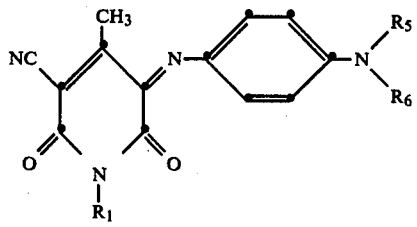

(2a)

wherein $R_1$ is hydrogen, alkyl of 1 to 6 carbon atoms or hydroxyalkyl of 2 to 4 carbon atoms, $R_5$ and $R_6$ are alkyl of 1 to 4 carbon atoms, hydroxyalkyl of 2 to 4 carbon atoms or sulpho-n-butyl or $R_5$ and $R_6$ together with the nitrogen atom to which they are attached are a piperidine, morpholine, piperazine or pyrrolidine ring, and especially such of formula (2a), wherein $R_1$ is alkyl of 1 to 6 carbon atoms, $R_2$ is hydrogen or methyl and $R_5$ and $R_6$ are ethyl or hydroxyalkyl of 2 to 4 carbon atoms.

Further compounds of formula (2) which are suitable for use in the process of the present invention are those wherein Z is cyano, —$COOR^3$, —$CONR^3R^4$ and —$COR^3$, wherein $R^3$ and $R^4$ have the meaning assigned to them above, the most preferred being those wherein Z is cyano.

Preferably both Y and $R_1$ are alkyl or substituted alkyl groups and most preferably both Y and $R_1$ are alkyl groups having from 1 to 4 carbon atoms as described above.

Another preferred class of compounds of formula (1) for use in the process of the present invention are those wherein $R_1$ is hydrogen. Such compounds may exist in the tautomeric form which may be written as formula

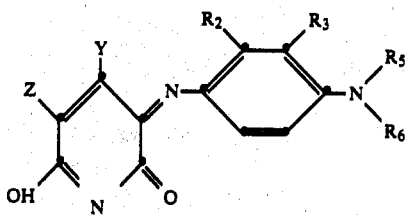

(3)

where the symbols have the meanings assigned to them above.

Preferably in the compounds of formulae (2) and (3) $R_2$, $R_3$ and $R_4$ are each hydrogen atoms. Preferably Y is an alkyl group having from 1 to 4 carbon atoms. Preferably $R_5$ and $R_6$ are alkyl or alkoxy groups wherein the alkyl moiety contains from 1 to 4 carbon atoms.

Particularly suitable compounds for use in the process of the present invention are the compounds of the formulae

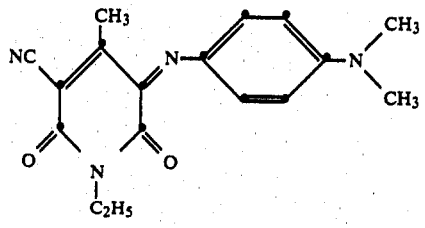

(4)

and

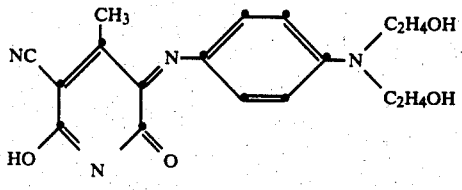

(5)

Another usefuls class of hydroxypyridone compounds are those of the general formula

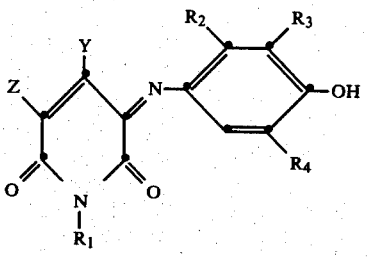

(6)

where Z, Y and $R_1$ to $R_4$ have the meanings assigned to them above.

An example of a compound of formula (6) is the compound of formula

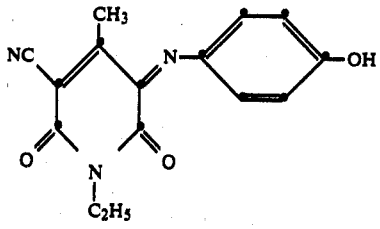

(7)

Another useful class of dyes of formula (1) are bishydroxypyridone dyes of the general formula

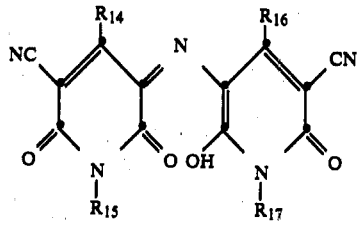

(8)

where each of $R_{14}$, $R_{15}$, $R_{16}$ and $R_{17}$ are alkyl with 1 to 4 carbon atoms, such as methyl, ethyl, propyl, i-propyl, butyl or t-butyl. These radicals may further be substituted with halogen, such as chlorine or bromine, hydroxyl, cyano or alkoxy having 1 to 4 carbon atoms. A further useful class of dyes of formula (1) are dyes of the formula

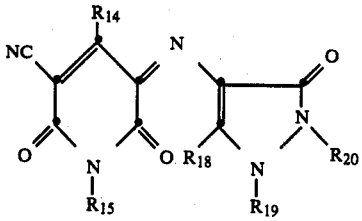

(9)

where $R_{14}$ and $R_{15}$ have the meanings assigned to them above, $R_{19}$ is alkyl having from 1 to 4 carbon atoms, such as methyl, ethyl, propyl or butyl. $R_{20}$ has the same meaning as $R_{19}$ and is further aryl e.g. phenyl or naphthyl. Phenyl is preferred. $R_{18}$ is hydrogen or alkyl having 1 to 4 carbon atoms. Examples are methyl, ethyl, propyl or butyl and the isomers i-propyl and t-butyl.

$R_{18}$, $R_{19}$ and $R_{20}$ are each alkyl. These alkyl groups can have 1 to 6 carbon atoms e.g. methyl, ethyl, propyl, butyl, pentyl or hexyl or isomers thereof, and are optionally substituted by halogen, such as chlorine or bromine, hydroxyl, alkoxy having 1 to 4 carbon atoms such as methoxy or ethoxy or butoxy, or a carboxylic acid group. Preferably, the alkyl groups are unsubstituted. Suitable alkyl radicals have 1 to 4 carbon atoms. Methyl is most preferred. $R_{18}$, $R_{19}$ and $R_{20}$ are further each aryl, e.g. phenyl or naphthyl, optionally substituted with halogen, such as chlorine or bromine, hydroxyl, cyano, nitro or a carboxylic acid group. Preferably, $R_{18}$, $R_{19}$ and $R_{20}$ are phenyl, optionally substituted with chlorine, hydroxyl or cyano. Phenyl is the most suitable radical for $R_{18}$, $R_{19}$ and $R_{20}$. $R_{18}$, $R_{19}$ and $R_{20}$ can have the same or a different meaning.

An example of a dye of formula (9) is the dye of formula

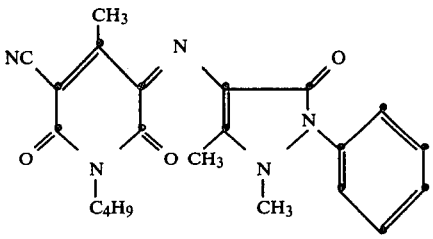

(10)

The hydroxypyridones of formula (2) may be prepared as described in DE-A-2.808.825.

The other compounds of formula (1) may be prepared by methods well known in the literature, for example by condensing the parent group of the formula

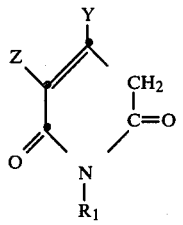

(11)

with a nitroso compound of the general formula

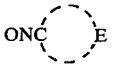

(12)

wherein the above two formulae $R_1$, Y, Z and E have the meaning assigned to them above.

Advantageously the reaction is carried out in a solvent, preferably acetone, ethanol or acetic acid, with or without heating.

The compounds of formula (1) are preferably present in the layer of the photographic material as a solid dispersion.

A method of making such a solid dispersion using gelatin as the binder is as follows A slurry of 5 to 20 g of the dye in 1 g of 10% solution of the adduct of 1 mol of octylphenol and 10 moles of ethylene oxide and 1 g of 10% solution of the sodium salt of the sulfonated adduct of 1 mol of octylphenol and 8 moles of ethylene oxide in 78 g of water is milled in a colloid mill (e.g. a Dyno Mill, at 3000 rpm charged with 0.7 to 1.0 mm grinding media) to a particle size distribution of less than 1 μm in diameter (mean 0.4 to 0.5 μm).

A solution of 4% gelatin (decationised blend, pH 6–7) containing 0.15% wetting agent is added gradually to the stirred dispersion. Hardener may be added at this stage. The concentration of the dispersion is adjusted so as to give a density of 3 at λ max (corresponding to coating weights of 20–30 mg $dm^{-2}$ of gelatin and 8–10 mg $dm^{-2}$ of the dye).

By silver halide developer is meant a compound which is able to develop a latent silver image in alkaline conditions.

All the well known black and white silver halide developers may be used in the process of the present invention. These include polyhydroxy phenols, for example hydroquinone, bromohydroquinone, chlorohydroquinone and pyrogallol, aminoanilines, aminophenols, for exmple p-aminophenol and p-methylaminophenol (metol) and glycin, as well as 1-phenyl-3-pyrazolidinone and ascorbic acid.

It is possible to use mixtures of said developers which comprise two or more different compounds. Preferably a mixture of hydroquinone and 1-phenyl-3-pyrazolidine is employed.

Further, some of the more unusual silver halide developers are of use in the process of the present invention.

These include compounds of the formula

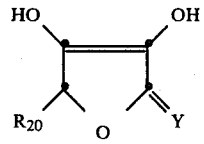

(13)

where $R_{20}$ is hydrogen, alkyl or aryl and Y is —O— or —NH—.

Preferred alkyl groups have 1 to 4 carbon atoms, e.g. methyl, ethyl and butyl. A suitable aryl group is phenyl (compounds of this class are closely related to ascorbic acid) and compounds of the formula

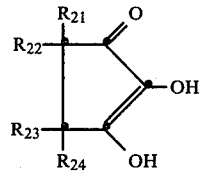

(14)

where $R_{21}$ to $R_{24}$ are each hydrogen, methyl or ethyl. Most preferably $R_{21}$ to $R_{24}$ are all methyl groups. This compound is known as tetramethyl reductic acid.

The process of the present invention may be used to form a dye image in a layer removed from the silver halide emulsion layer or it may be used to form a dye image which reinforces a silver image in which case the bleachable dye layer is present in the assembly adjacent to the silver halide emulsion layer.

When the process of the present invention is used to produce a dye image in a layer removed from the silver halide emulsion layer the photographic assembly of the type defined may consist of two components, one the image portion and the other the photosensitive portion, preferably with a stripping layer or position between the silver halide emulsion layer(s) and the image dye layer.

However the process of the present invention may be used in an in-camera process when preferably processing liquid is introduced between two layers of the photographic assembly from a pod and the two portions of the assembly are brought into close contact.

In this case it is necessary that the silver halide developer agent is not present in the processing solution as this would bleach the bleachable dye instantly but that the developer agent is placed on the photographic assembly on the side of the silver halide emulsion layer remote from the bleachable dye layer. The developer is preferably present as a solid dispersion. Suitable developers are hydroquinone or a derivative thereof, such as bromohydroquinone, chlorohydroquinone or pyrogallol.

When there is a stripping layer or stripping position sometimes a final step in the process of the present invention is required to activate the stripping effect and to separate the portion of the photographic assembly which comprises the developed silver image from the portion which contains the final dye image on the photobase.

If there is a stripping layer this may be dissolved in a final wash or solution bath. An example of a suitable stripping layer is a phthalated gelatin layer which is swellable in water. However usually the stripping effect takes place during the processing, because, for example, phthalated gelatin is swellable in an alkaline processing solution.

Alternatively there may be a stripping position, that is to say the interface between two layers is such that adhesion failure between the two layers can be caused. This adhesion failure may be caused, for example, by change of pH or temperature. The stripping position should be between the silver halide emulsion layer(s) and the image dye layer so that the final step in the process may be to activate the adhesion failure so separating the photosensitive portion from the image portion. However it is usual for adhesion failure to occur towards the end of processing so that often no actual step to activate stripping is required.

When there is either a stripping layer or stripping position in the photographic assembly all the silver used as the photosensitive agent can be recovered as the portion of the material containing the silver may be separated from the final image portion.

However there is some saving in silver even when the image portion is not separated from the portion containing the silver. In this case the final viewable image is the dye image which is viewed through the transparent support, there being also a silver image in the photographic material which is likely to be separated from the dye image by a white opaque layer. In such material the amount of silver halide present in the silver halide emulsion layer(s) can be less than that which would be required if a viewable image were to be formed in the silver halide emulsion layer(s).

When the process of the present invention is used in a process to produce a dye image which reinforces a silver image it is usually necessary to provide a silver halide fixing step which removes the unexposed silver halide from the photographic assembly.

Various embodiments of photographic assemblies of use in the present invention will now be described with reference to the accompanying FIGS. 1 to 11.

It should be noted that negative working silver halide emulsions as well as positive working emulsions can be used.

In FIGS. 1 to 6 the term stripping position has been used, however this may be either an interface between layers at which adhesion failure may occur or it may indicate an actual stripping layer.

Figure 1:
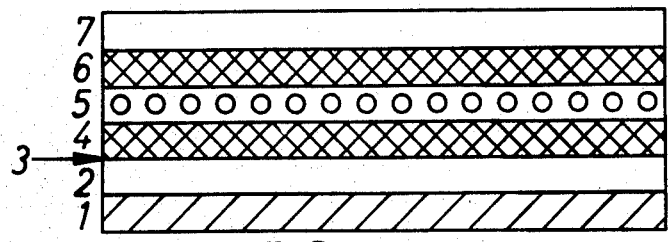
FIGS. 1 to 6 show assemblies which comprise either a stripping position or stripping layer.

In FIG. 1 there is shown a photographic material according to the present invention which can be used for X-ray film material.

As shown in FIG. 1 the material comprises a transparent support 1 having coated thereon a bleachable dye-in-gelatin layer 2. Above this is the stripping position 3. Above the stripping position 3 is a carbon black layer 4 and above this a conventional silver halide emulsion layer 5, then a carbon black layer 6 and above is a supercoat layer 7. Thus the silver halide emulsion layer 5 is sand-wiched between two carbon black layers 4 and 6 and therefore the photographic material can be handled in daylight. The material may be exposed to X-rays and after exposure it can be processed using an aqueous alkaline solution of the bleach-developer as just described to yield a negative silver image. The silver halide layer and the two carbon black layers and the supercoat layer are then stripped off the dye layer for recovery of the silver. The negative dye image on the support can then be viewed by transmission.

For convenience the expression "X-ray" as used in the specification is intended to cover all very short wave photographically usefu radioactive rays such as those emanating from an X-ray tube, radium or radioactive isotopes and nuclear radiation including $\beta$ particles.

Figure 2:
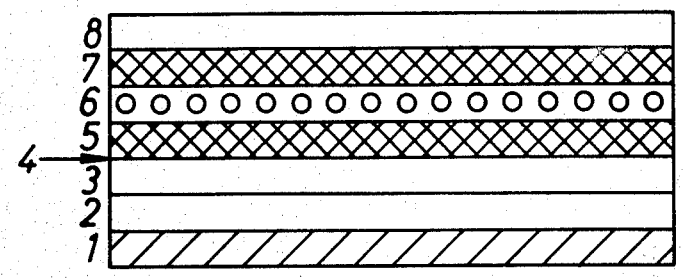

In FIG. 2 there is shown photographic material according to the present invention which can be used as X-ray material for reflection viewing. In this embodiment there is coated on a transparent film support 1 in order a bleachable dye-in-gelatin layer 2, a white opaque layer 3, stripping position 4, a carbon black layer 5, a conventional silver halide emulsion layer 6, a carbon black layer 7 and a supercoat layer 8.

In this case as in the case of the material of FIG. 1 the photographic material is processed to yield a negative image. But in this material an extra white opaque layer is present. This may comprise for example of baryta or titanium oxide dispersed in gelatin. In this material the white opaque layer acts as a reflective base for the negative dye image which is viewed by reflection through the film support.

Figure 3:
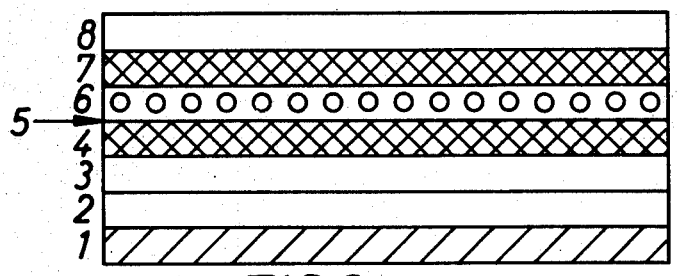
Figure 4:
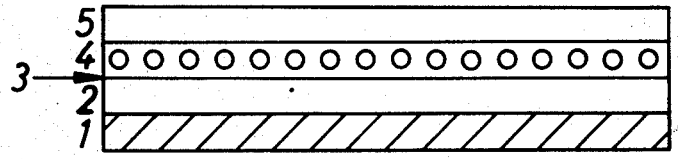

FIG. 3 shows an alternative embodiment of the material of FIG. 2. In this figure the layers have the same numbers as in FIG. 2 but the stripping position has now been altered and is between the lower carbon black layer 5 and the silver halide emulsion layer 6. When the silver halide emulsion layer is stripped off after processing the carbon black layer is then attached to the white opaque layer.

The main advantages of the photographic material as described with reference to FIGS. 1 to 3 is that all silver in the silver halide emulsion layer may be recovered and the film material is insensitive to daylight and thus may be handled in the unexposed state in normal daylight conditions. However the photographic material of the present invention can also be used in a normal camera or process camera if the top carbon black layer is omitted. Such material in which there is no carbon black layer at all is shown in the accompanying FIG. 4 in which there is coated on an opaque support 1 in order a bleachable dye-in-gelatin layer 4 and a supercoat layer 5. Preferably this material comprises in layer 4 a direct positive emulsion and thus when processed yields a direct positive dye image which is viewed by reflection. In this case the material cannot be handled at any stage in daylight conditions before the silver halide layer has been stripped off.

Figure 5:
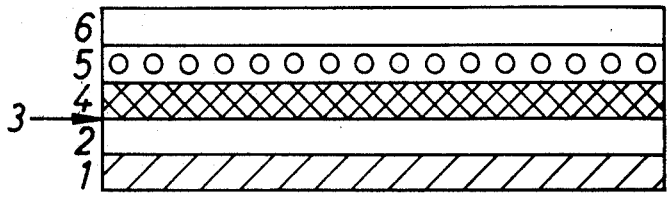

Yet another embodiment of the material of the present invention is shown in the accompanying FIG. 5. In this material there is coated on a transparent support 1 in order a bleachable dye-in-gelatin layer 2, stripping position 3, carbon black layer 4, silver halide emulsion layer 5 and supercoat layer 6. In this case the material produces a final dye image which may be viewed by transmission. In the case of this material exposure must be in a camera or other light-tight exposure chamber.

Figure 6:
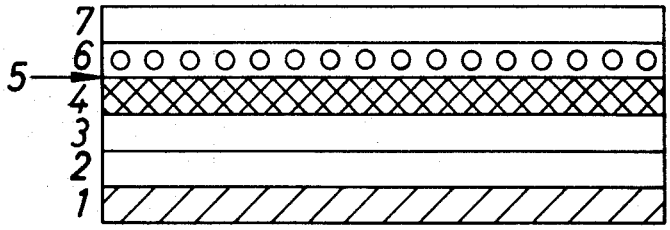

Another embodiment of the invention is shown in FIG. 6 in which there is coated on a transparent support 1 in order a bleachable dye-in-gelatin layer 2, white opaque layer 3, carbon black layer 4, stripping position 5, silver halide layer 6 and supercoat layer 7. In this case also, exposure must be in a camera or light-tight exposure chamber. The silver halide emulsion layer 6 may be a direct positive emulsion and in which case after processing there is produced a direct positive image which is viewed by reflection. Alternatively if a conventional silver halide emulsion is used there is produced a negative image which is viewed by reflection, although of course it would be more usual in this case to employ material which would produce a direct positive image as the image is viewed by reflection unless exposure were to X-rays, when it is usual to view negative images.

The assemblies shown in FIGS. 1 to 6 may be processed by the application of an aqueous alkaline solution which comprises a silver halide developer.

Figure 7:
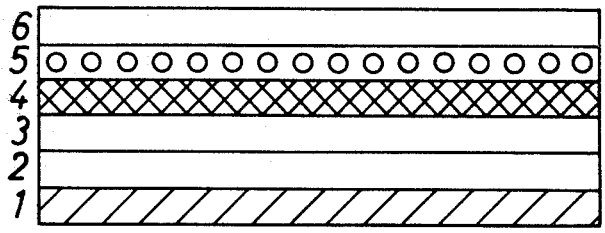
FIGS. 7 and 8 show integral assemblies.
Figure 8:
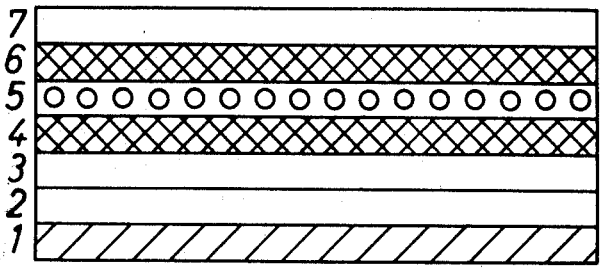
Figure 9:
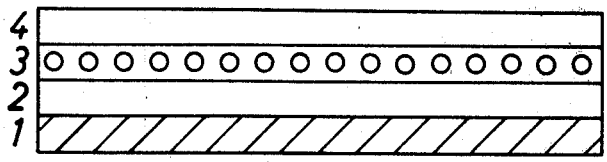
FIG. 9 shows an assembly suitable for dye-image reinforcement of a silver image.

Photographic assemblies of use in the present invention which are integral, i.e. which remain in one piece after processing, are shown in FIGS. 7 to 9.

In FIG. 7 there is coated on a support 1 in order a bleachable dye-in-gelatin of formula (1) layer 2, a white reflecting layer 3, a carbon black opacifying layer 4, a silver halide emulsion layer 5 and a supercoat layer 6. Exposure must be in a camera or light-tight exposure chamber. The emulsion layer 5 may be chosen to produce a positive image or a negative image.

In FIG. 8 there is coated on a support 1 in order a bleachable dye-in-gelatin of formula (1) layer 2, a white reflecting layer 3, a carbon black opacifying layer 4, a silver halide emulsion layer 5, a carbon black opacifying layer 6 and a supercoat layer 7. Exposure of this material must be to X-rays. The silver halide emulsion of this layer would normally be a conventional emulsion so yielding a negative image to be viewed by reflection as X-ray films are by custom processed to yield negative images.

In neither of the assemblies shown in FIGS. 7 and 8 is there a stripping position or layer. This means that all the silver present initially is still present in the final image material. However it is possible to make use of a very low coating weight of silver which when the material is exposed and processed yields a very low density image, too low in fact to be of use as a final image. However the final image in the assemblies of FIGS. 7 and 8 is a dye image of very acceptable density as a final image. Thus the amount of silver used an be small as the silver is used merely as the radiation sensitive agent and not as the image-producing substance as well, although it is still present in the assembly but is invisible as it is on the other side of the white reflecting layer to the dye image.

In FIG. 9 there is coated on a support 1 in order a bleachable dye-in-gelatin of formula (1) layer 2, a silver halide emulsion layer 3 and a supercoat layer 4. Exposure of this material must be carried out in a light-tight exposure chamber such as a camera or an X-ray film cassette. The exposed film must also be processed in a dark room. On processing, i.e. applying an aqueous alkaline processing bath to the supercoat, a silver image is obtained which is reinforced by a dye image because in the areas in which there is no latent image the silver halide developer diffuses through to the dye-in-gelatin layer and there bleaches the dye imagewise, leaving a dye image which correspond to the developed silver image. This dye image reinforces the silver image and allows a decrease in the silver coating weight without any reduction in the density of the final image.

The emulsion layer 3 may be chosen to produce either a negative or a positive image.

Figure 10:
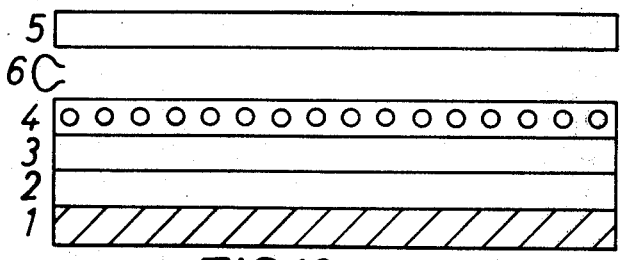
FIGS. 10 and 11 show assemblies in two sections suitable for incamera processing.

In FIG. 10 there is shown a photographic assembly of use in the present invention which comprises two separate components. The first component consists only of a dummy web 5. The other component comprises a transparent support 1 having coated thereon in order a bleachable image dye layer 2, a white reflecting layer 3 and a silver halide layer 4. Between the dummy web 5 and the silver halide layer 4 is shown a pod 6 which contains an aqueous alkaline silver halide developing solution.

The assembly of FIG. 10 is of use in a self-processing camera of the type known per se. In operation the assembly with the dummy web 5 in close contact with the silver halide emulsion layer 4 is imagewise exposed in a camera. Preferably the pod 6 is present in the assembly with its outlet between two edges of the supercoat and silver halide layers but is so positioned that close optical contact between these two layers is not impaired.

After exposure the assembly is led through a pair of driven rollers which rupture the pod 6 and cause the processing fluid contained therein to spread evenly between the dummy web 5 and the silver halide layer 4. The silver halide developer then diffuses into the silver halide layer and develops the latent image therein in the latent image areas. In the non-latent image areas it diffuses in a counterimagewise manner through the white reflecting layer 3 and into the dye(s)+gelatin layer 2 where it bleaches the bleachable dye to form a dye image. The image can then be viewed by reflection through the support 1.

Figure 11:
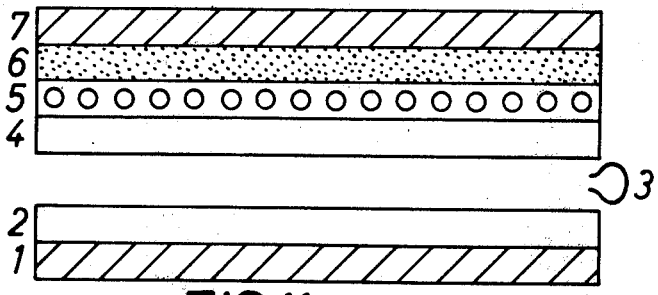

In FIG. 11 there is shown also a photographic assembly of use in the present invention which comprises two separate components. The first component consists of a support 1, a bleachable dye of formula (1) in a gelatin layer 2, the second component comprises a supercoat layer 4, a silver halide layer 5, a gelatin layer 6 which comprises incorporated therein a developing agent, for example hydroquinone, and a support 7. Between the bleachable dye layer 2 and the supercoat layer 4 is shwon a pod 3 which comprises an aqueous alkaline solution.

The assembly of FIG. 11 is of use in a self-processing camera of the type known per se.

In operation the silver halide layer of the second component is exposed through the support 7 in a camera. The pod 3 is present in the assembly with its outlet between the edges of the supercoat layer 4 and the bleachable dye layer 2. After exposure the assembly is passed through a pair of driven rollers which rupture the pod 3 and cause the processing fluid contained therein to spread the aqueous alkaline solution evenly between the supercoat layer 4 and the bleachable dye layer 2. The alkaline processing fluid diffuses to the layer which comprises the incorporated developer where it liberates and dissolves the developer which then diffuses to the exposed silver halide layer. In the latent image areas the developer develops the exposed silver halide and becomes exhausted, but in the non-latent image areas the developer diffuses in a counter-imagewise manner to the bleachable dye layer 2 where it bleaches the bleachable dye to form a dye image. The first component can then be removed from contact with the second component and the dye image can be viewed directly or through the support base.

An example of a suitable white reflecting layer for use in the material of FIGS. 2, 3, 6, 7, 8 and 10 is as follows:

| | |
|---|---|
| Titanium dioxide (mean particle size 1.5μ) | 15 g |
| Gelatin (4% aqueous solution) | 50 ml |
| Sodium dodecyl sulphate (28% aqueous solution) | 0.3 ml |
| Aryl alkyl polyethylene oxide condensate (6% solution in 50/50 ethanol/water) | 3.0 ml |

dispersed using a homogeniser or ultrasonic mixer coated to give a layer containing 27 g $m^{-2}$ $TiO_2$.

An example of a suitable carbon black layer for use in the material of FIGS. 1 to 3 and 5 to 8 is as follows:

| | |
|---|---|
| Gelatin | 3 g |
| Water | 40 ml |
| Carbon Black dispersion | 5 g |
| Wetting agent (5% aqueous solution) | 2.5 ml |

mixed gently for two minutes coated to give a layer containing 2.7 g $m^{-2}$.

There may be present in the photographic material of the present invention yet other layers, for example a neutralising layer, a timing layer or a layer to control the swelling of the gelatin layers. Preferably any of the above layers, if present, are located between the supercoat layer and the silver halide emulsion layer or between the dye layer and the support so as not to prolong nor interfere with the diffusion path of the bleach developer to the bleachable dye layer.

The preferred binder for all layers is gelatin. However so-called gelatin extenders may be present for example those derived from synthetic colloid latexes, especially acrylic latexes. Other natural or synthetic binders may be used either alone or in admixture with the gelatin, for example albumin, casein, polyvinyl alcohol and polyvinyl pyrrolidine.

The halide content and ratio of the silver halide present in the silver halide emulsion layer depends on how the material is to be used, but all the usual pure bromide, chlorobromide, iodobromide and chlorobromoiodide silver halides are of use in the photographic material in use in the process of the present invention. There may also be present in the silver halide emulsion layer any of the usual addenda present in silver halide emulsion layers such as sulphur and gold sensitizers, emulsion stabilizers, wetting agents and antifoggants.

The support used may be of any ot the usual supports used for photographic materials, for example if the support is transparent it may be composed of cellulose triacetate, cellulose acetatebutyrate, oriented and subbed polystyrene, polycarbonate or polyester, such as polyethylene terephthalate. If the support is opaque it may be of any of the above listed film base materials which has been pigmented for example with barium sulphate or titanium dioxide to render its coated surface reflecting, or it may be a paper support having a baryta coating thereon or polyethylene coated paper base. Alternatively it may be voided polyester support.

As hereinbefore stated processing is preferably carried out in an aqueous medium and this is preferably rendered alkaline with a suitable alkali or a buffer mixture, advantageously to a pH value between 9 and 11. The processing and developing speed and the gradation can be varied within wide limits as a function of the pH value.

Preferably an antifoggant is present in the aqueous alkaline processing medium for example iodide or bromide ions or 1-phenyl-5-mercapto-tetrazole.

The following Examples will serve to illustrate the invention.

EXAMPLE 1

Three samples of photographic material as shown in FIG. 9 are prepared by coating sequentially onto 0.1 mm thick uncoloured transparent cellulose triacetate support the following layers:

1. a gelatin layer containing 2.0 g/$m^2$ of the azamethine dyestuff of the formula

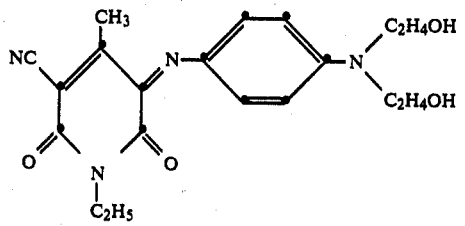

(101)

in gelatin having a coating weight of 4 g/$m^2$.

2. a photosensitive silver halide gelatin emulsion layer containing 1.6 g/$m^2$ silver in the form of silver bromide in gelatin 2.0 g/$m^2$.
3. a supercoat layer containing gelatin 1.0 g/$m^2$.

All three samples are imagewise exposed to a negative film image and then processed for 45 seconds at 40° C. in a silver halide developing solution of the following composition:

| | |
|---|---|
| hydroquinone | 40 g/liter |
| sodium carbonate | 25 g/liter |
| sodium bicarbonate | 20 g/liter |
| Water to | 1 liter |
| pH about 10 | |

Sample 1

This sample is fixed in ammonium thiosulphate solution for 40 seconds and washed but is not processed further. In sample 1 after the processing there is left in the assembly a positive silver image which is reinforced by a positive dye image.

Sample 2

This sample after the above processing in a silver halide developing solution to produce the positive silver and dye images is fixed for 40 seconds in an ammonium thiosulphate based fixer solution, washed in water for 5 minutes and then treated for 4 minutes with a 0.2% solution of 1-phenyl-3-pyrazolidone at pH 10. The 1-phenyl-3-pyrazolidinone bleaches all the remaining dye, thus resulting in a positive silver image only. The sample was finally fixed again in ammonium thiosulphate solution.

Sample 3

This sample after the above processing in a silver halide developing solution to produce the positive silver and dye images is processed for 5 minutes in a bath containing 5% cupric bromide to bleach the developed silver image. The sample is then treated for 4 minutes in an ammonium thiosulphate based fixer. This results in a positive dye image only.

The densities of the final images in the three samples are then compared:

| | D max | D min |
|---|---|---|
| Sample 1 (silver + dye image) | 2.52 | 0.30 |
| Sample 2 (silver image only) | 1.50 | 0.23 |
| Sample 3 (dye image only) | 1.14 | 0.25 |

EXAMPLE 2

Three further samples are prepared as in Example 1 and after imagewise exposure to a negative film image are processed for 45 seconds at 40° C. in a silver halide developing solution of the following composition:

| | |
|---|---|
| hydroquinone | 20 g/liter |
| sodium carbonate | 25 g/liter |
| sodium bicarbonate | 20 g/liter |
| water to | 1 liter |
| pH about 10 | |

Sample 1 is left as in Example 1 to provide a silver+dye positive image.

Sample 2 is further treated as in Example 1 to provide a positive silver image only.

Sample 3 is further treated as in Example 1 to provide a positive dye image only.

The densities of the final images in the three samples are then compared:

| | D max | D min |
|---|---|---|
| Sample 1 (silver + dye image) | 2.46 | 0.39 |
| Sample 2 (silver image only) | 1.5 | 0.7 |
| Sample 3 (dye image only) | 1.1 | 0.34 |

EXAMPLE 3

Three samples of photographic material as shown in FIG. 9 are prepared by coating sequentially onto 0.1 mm thick uncoloured transparent cellulose triacetate support the following layers:

1. a gelatin layer containing 2.0 g/m$^2$ of the azamethine dyestuff of the formula (4) in gelatin having a coating weight of 4.0 g/m$^2$.
2. a photosensitive silver halide gelatin emulsion layer containing silver iodobromide ($Br^{\ominus}$ 98.4% and $I^{\ominus}$ 1.6%). Silver coating weight 4.5 g/m$^2$ and gelatin coating weight 5.0 g/m$^2$.
3. a supercoat layer containing gelatin 1.0 g/m$^2$.

All three samples are imagewise exposed to a step wedge and then processed for 20 seconds at 40° C. in a silver halide developing solution of the following composition:

| | |
|---|---|
| hydroquinone | 50 g/liter |

-continued

| | |
|---|---|
| 1-phenyl-3-pyrazolidinone | 5 g/liter |
| sodium carbonate | 30 g/liter |
| sodium bicarbonate | 5 g/liter |
| sodium sulphite | 5 g/liter |
| water to | 1 liter |
| pH about 10 | |

Sample 1 is left as in Example 1 to provide a silver+dye image.

Sample 2 is further treated as in Example 1 to provide a silver image only.

Sample 3 is further treated as in Example 1 to provide a dye image only.

The densities of the final images in the three samples are then compared.

| | D max | D min |
|---|---|---|
| Sample 1 (silver + dye image) | 1.95 | 0.27 |
| Sample 2 (silver image only) | 1.01 | 0.33 |
| Sample 3 (dye image only) | 1.16 | 0.33 |

EXAMPLE 4

A sample of photographic material as shown in FIG. 11 is prepared. The first component comprises a 0.1 mm thick uncoloured transparent cellulose triacetate support 1 coated with a gelatin layer 2 containing 2.0 g/m$^2$ of the azamethine dyestuff used in Example 1. The second component comprises a gelatin superocoat layer containing 1.0 g/m$^2$ of gelatin 4, a photosensitive silver halide emulsion layer 5 as used in Example 1, a gelatin layer 6 which comprises incorporated therein 2.0 g/m$^2$ of the developing agent of the formula

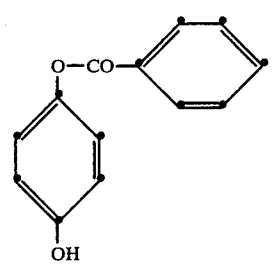

(102)

in gelatin having a coating weight of 4 g/m$^2$ and a 0.1 mm thick uncoloured transparent cellulose support 7.

The silver halide emulsion layer in the second component is exposed through the supercoat layer 4 to a step wedge.

A 1 M sodium hydroxide solution at room temperature is coated on the supercoat layer 4 and the dye layer 2 is pressed against the supercoat layer, with the processing solution sandwiched between, for 1 minute. After 1 minute the first component, that is to say the dye layer 2 on the support 1, is removed from contact with the supercoat layer and washed. A clear dark blue image, negative in relation to the step wedge, is obtained in the image layer 2.

EXAMPLE 5

A sample of photographic material similar to that shown in FIG. 7, except that the opaque layer 4 is omitted is prepared by coating sequentially onto 0.1 mm thick uncoloured transparent cellulose triacetate support the following layers:

1. a gelatin layer containing 2.0 g/m$^2$ of the azamethine dyestuff of the formula

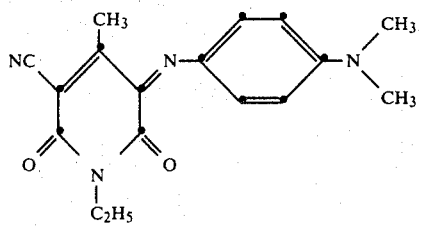

(103)

in gelatin having a coating weight of 4 g/m$^2$
2. a titanium dioxide layer
3. a photosensitive silver halide gelatin emulsion layer containing silver iodobromide (Br$^{\ominus}$ 98.4% and I$^{\ominus}$ 1.6%). Silver coating weight 4.5 g/m$^2$ and gelatin coating weight 10 g/m$^2$
4. a supercoat layer containing gelatin 1.0 g/m$^2$.

The sample is imagewise exposed to a step wedge and then processed for 40 seconds at 40° C. in a silver halide developing solution of the following composition:

| | |
|---|---|
| hydroquinone | 50 g/liter |
| 1-phenyl-3-pyrazolidinone | 2.5 g/liter |
| sodium carbonate | 30 g/liter |
| sodium bicarbonate | 5 g/liter |
| sodium sulphite | 5 g/liter |
| water to | 1 liter |
| pH about 10 | |

A clear dark blue image is obtained with a D max of 1.30 and a D min of 0.44 which can be viewed through the transparent base against the opaque titanium oxide layer as a background.

EXAMPLE 6

A sample of photographic material as shown in FIG. 10 except that the dummy web is changed to an integral supercoat is prepared by coating onto a 0.1 mm thick uncoloured transparent cellulose triacetate support 1 a gelatin layer 2 containing 2.0 g/m$^2$ of the azamethine dyestuff of formula (103). There is coated on this layer a titanium dioxide layer 3, prepared as hereinbefore set forth. There is coated on this layer a photosensitive silver halide emulsion layer 4 containing silver iodobromide (Br$^{\ominus}$ 98.4% and I$^{\ominus}$ 1.6%). The silver coating weight is 5.0 g/m$^2$ and the gelatin coating weight 10 g/m$^2$. On this layer is coated a supercoat layer 5 containing gelatin 1.0 d/m$^2$.

The material is imagewise exposed to a step wedge and then a processing solution of the following composition is applied to the supercoat layer and allowed to remain in contact for 40 seconds:

| | |
|---|---|
| hydroquinone | 50 g/liter |
| 1-phenyl-3-pyrazolidinone | 2.5 g/liter |
| sodium carbonate | 30 g/liter |
| sodium bicarbonate | 5 g/liter |
| sodium sulphite | 5 g/liter |
| water to | 1 liter |

-continued

| | |
|---|---|
| pH about 10 | |

A clear bluish image is obtained in layer 2 having a D min 0.44 and a D max 1.30.

EXAMPLE 7

A sample of photographic material similar to that shown in FIG. 9 is prepared by coating sequentially onto 0.1 mm thick uncoloured transparent cellulose triacetate support the following layers:

1. a gelatin layer containing a 5 mg/dm$^{-2}$ solid dispersion of the dyestuff of formula

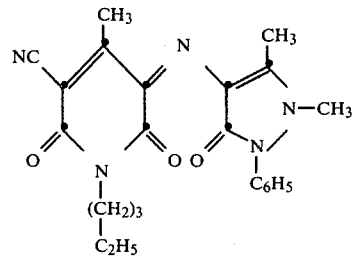

(104)

in gelatin at a coating weight of 30 mg/dm$^{-2}$,
2. a silver halide photographic emulsion 10 mg/dm$^2$ in gelatin 37 mg/dm$^2$,
3. a supercoat of gelatin 6 mg/dm$^2$.

This material is exposed through a grey wedge for 30 seconds and then processed for 1 minute in a developing solution of the following composition:

| | |
|---|---|
| hydroquinone | 3.1 g |
| 1-phenyl-3-pyrazolidinone | 0.8 g |
| sodium sulphite | 13 g |
| potassium hydroxide | 0.6 g |
| potassium bromide | 0.5 g |
| potassium carbonate | 15 g |
| ethylene diamine tetra-acetic acid disodium salt | 1.5 g |
| water to make | 1 liter |
| pH 11.0 | |

A combined silver and dye image of the wedge is obtained, with a silver density of 2 and a dye density of 0.7.

We claim:

1. A process for the production of a photographic image which comprises the steps of (a) imagewise exposing a photographic assembly which comprises at least during a silver halide developing step, in order optionally a supercoat layer, at least one silver halide emulsion layer, a layer containing a layer substantive hydroxypyridone azamethine compound of the formula

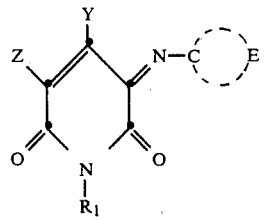

(1)

wherein $R_1$ is hydrogen, optionally substituted alkyl, aralkyl, cycloalkyl or aryl, or an optionally substituted heterocyclic radical or an amino group, Y is hydrogen, hydroxyl, cyano, —$COOR^1$, —$CONR^1R^2$ or —$COR^1$, optionally substituted alkyl, aralkyl, cycloalkyl, aryl or an optionally substituted heterocyclic radical, Z is hydrogen or is cyano, —$COOR^3$, —$CONR^3R^4$, —$SO_3H$, —$SO_3^-$ or —$COR^3$, where $R^1$, $R^2$, $R^3$ and $R^4$ each independently are hydrogen, optionally substituted alkyl, aralkyl, cycloalkyl or aryl or an optionally substituted heterocyclic radical, and E represents the atoms necessary to complete an optionally substituted heterocyclic or aromatic ring, and a support, there being optionally one or more interlayers between each of said components, (b) treating the exposed photographic assembly with an aqueous alkaline processing bath so as to provide in the silver halide emulsion layer or layers a solution or dispersion of a silver halide developer compound selected from the group consisting of a polyhydroxypheonol, an aminoaniline an aminophenol, glycine, a 1-phenyl-3-pyrazolidinone, ascorbic acid or a compound of the formulae

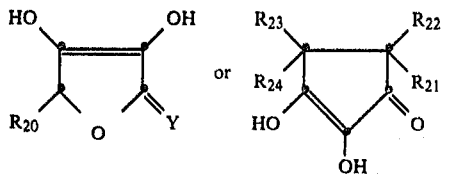

wherein $R_{20}$ is hydrogen, alkyl having 1 to 4 carbon atoms or phenyl, $R_{21}$, $R_{22}$, $R_{23}$ and $R_{24}$ are each hydrogen, methyl or ethyl and Y is —O— or —NH—, thereby to develop the latent silver image in the silver halide emulsions(s), and (c) in the non-latent image areas allowing the silver halide developer to diffuse in a counter-imagewise manner from the silver halide emulsion layer(s) to the layer containing the compound of formula (1) and there to bleach the compound to form a photographic dye image.

2. A process according to claim 1 wherein the compound has the formula

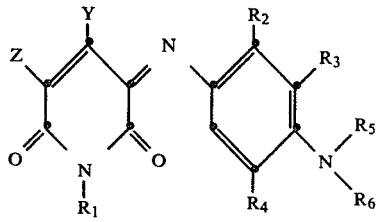

(2)

where $R_1$, X and Z have the meanings assigned to them above, $R_2$, $R_3$, $R_4$ each independently are hydrogen, halogen, optionally substituted alkyl or cycloalkyl, or alkoxy, and $R_5$ and $R_6$ each independently are hydrogen or optionally substituted alkyl, aralkyl, cycloalkyl or aryl or an optionally substituted heterocyclic radical or $R_5$ and $R_6$ together with the nitrogen atom to which they are attached form a 5- or 6-membered ring, or $R_3$ and $R_5$ together with the nitrogen atom and $R_5$ and $R_6$ together with the nitrogen atom form two condensed rings.

3. A process according to claim 1 wherein Z is cyano, —$COOR^3$, —$CONR^3R^4$ or —$COR^3$ where $R^3$ and $R^4$ have the meanings assigned to them in claim 1.

4. A process according to claim 3 wherein Z is cyano.

5. A process according to claim 1 wherein $R_1$ is hydrogen or alkyl having from 1 to 4 carbon atoms.

6. A process according to claim 1 wherein $R_1$ is hydrogen.

7. A process according to claim 1 wherein Y is alkyl having from 1 to 4 carbon atoms.

8. A process according to claim 2 wherein $R_2$, $R_3$ and $R_4$ are each hydrogen.

9. A process according to claim 2 wherein $R_5$ and $R_6$ are the same and are alkyl or alkoxy groups both having from 1 to 4 carbon atoms.

10. A process according to claim 2 wherein the dyestuff has the formula

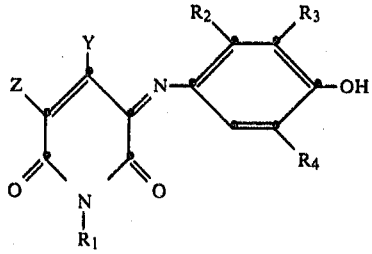

(6)

wherein $R_1$, $R_2$, $R_3$ and $R_4$, Y and Z have the meanings assigned to them in claim 2.

11. A process according to claim 1 wherein the dyestuff has the formula

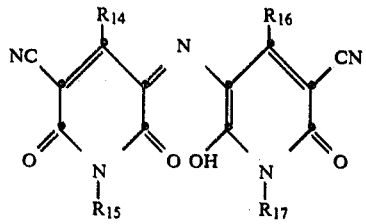

(8)

where each of $R_{14}$, $R_{15}$, $R_{16}$ and $R_{17}$ are methyl or ethyl.

12. A process according to claim 1 wherein the dyestuff has the formula

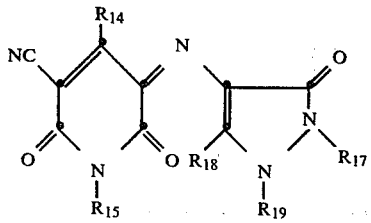

(9)

where $R_{14}$ and $R_{15}$ have the meanings assigned to them in claim 11, $R_{19}$ is alkyl having from 1 to 4 carbon atoms, $R_{20}$ is alkyl or aryl and $R_{18}$ is hydrogen or alkyl having from 1 to 4 carbon atoms.

13. A process according to claim 1 wherein the dyestuff is present in a layer of the photographic assembly as a solid dispersion.

14. A process according to claim 1 wherein the silver halide developer is hydroquinone or a derivative of hydroquinone.

15. A process according to claim 1 wherein a mixture of two or more silver halide developers is used.

16. A process according to claim 15 wherein the mixture of silver halide developers comprises hydroquinone and 1-phenyl-3-pyrazolidinone.

17. A process according to claim 1 wherein the silver halide developer is present initially in the photographic assembly before exposure and processing thereof, the silver halide developer being on the side of the silver halide emulsion layer remote from the layer which comprises the dyestuff of formula (1).

18. A process according to claim 17 wherein the silver halide developer is present as a solid dispersion.

19. A process according to claim 17 wherein the silver halide developer is hydroquinone or a derivative thereof.

20. A process according to claim 1 wherein the photographic assembly is prepared as a single assembly which contains the supercoat, the silver halide emulsion layer and the layer which contains a compound of formula (1) coated on the support.

21. A process according to claim 20 wherein the aqueous alkaline processing bath is applied to the supercoat.

22. A process according to claim 20 wherein in the photographic assembly the silver halide emulsion layer and the layer which contains a compound of formula (1) are adjacent and after processing the dye image reinforces the silver image.

23. A process according to claim 20 or wherein in the photographic assembly used there is either a stripping layer or a stripping position between the silver halide emulsion layer(s) and the layer which contains a compound of formula (1).

24. A process according to claim 23 wherein the stripping layer comprises phthalated gelatin.

25. A process according to claim 1 wherein in the photographic assembly there is at least one light opaque layer adjacent to a silver halide emulsion layer.

26. A process according to claim 25 wherein there is one silver halide emulsion layer and there is a light-opaque layer on each side thereof.

27. A process according to claims 1 or 24 wherein in the photographic assembly there is a white reflecting layer adjacent to the layer containing a compound of formula (1) on the side remote from the support.

28. A process according to claim 1 wherein the photograhic assembly contains in order a supercoat layer, a light opaque layer, a silver halide emulsion layer, a light opaque layer, a layer containing a compound of formula (1) and a support.

29. A process according to claim 28 wherein there is present between the second mentioned light opaque layer and the layer containing a compound of formula (1) a stripping position or stripping layer.

30. A process according to claim 28 wherein there is present between the second mentioned light opaque layer and the layer containing a compound of formula (1) a white reflecting layer.

31. A process according to claim 30 wherein there is present between the second mentioned light opaque layer and the white reflecting layer a stripping position.

32. A process according to claim 1 wherein the photographic assembly is prepared as two sections, one section comprising the supercoat and the silver halide emulsion layer(s) and the other section comprising the layer which contains a compound of formula (1).

33. A process according to claim 1 wherein the silver halide emulsion is a negative working silver halide emulsion.

34. A process according to claim 1 wherein the silver halide emulsion is a direct positive silver halide emulsion.

* * * * *